US006630040B2

(12) United States Patent
Kneisl

(10) Patent No.: US 6,630,040 B2
(45) Date of Patent: Oct. 7, 2003

(54) SLURRY COATING METHOD FOR AGGLOMERATION OF MOLDING POWDERS REQUIRING IMMISCIBLE LACQUER SOLVENTS

(75) Inventor: Philip Kneisl, Pearland, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/062,237

(22) Filed: Jan. 31, 2002

(65) Prior Publication Data

US 2003/0140994 A1 Jul. 31, 2003

(51) Int. Cl.[7] ..... C06B 45/10; C06B 25/00; C06B 25/34

(52) U.S. Cl. ..... 149/19.92; 149/88; 149/92

(58) Field of Search ..... 149/19.92, 88, 149/92, 109.6; 264/3.4

(56) References Cited

U.S. PATENT DOCUMENTS 3,976,522 A 8/1976 Rothenstein
4,014,720 A * 3/1977 Wells ..... 149/19.8
4,168,191 A * 9/1979 Benziger ..... 149/19.91
4,462,848 A 7/1984 Elrick
5,092,944 A 3/1992 Stott et al.
5,468,313 A 11/1995 Wallace et al.
5,750,921 A 5/1998 Chan et al.
6,485,587 B1 * 11/2002 Han et al. ..... 149/19.92

OTHER PUBLICATIONS

Kaye, S.M., Encyclopedia of Explosive & Related Items, 1978, v9:62–65, US Army Armament Research & Development Command.

* cited by examiner

*Primary Examiner*—Michael J. Carone
*Assistant Examiner*—Aileen B. Felton
(74) *Attorney, Agent, or Firm*—Tim W. Curington; Jeffrey E. Griffin; Brigitte L. Jeffrey

(57) ABSTRACT

Solutions and process are described useful to produce coated HE powder granules in an aqueous slurry agglomeration process. A reaction mixture is made utilizing a lacquer stock solution comprising a binder material dissolved in a substantially aqueous-immiscible organic lacquer solvent, and an aqueous HE powder slurry solution comprising a non-aqueous soluble HE powder and an at least partially aqueous-miscible organic co-solvent. The co-solvent acts as an entrainer and improves the immiscible of the lacquer solvent in the water phase of the aqueous HE powder slurry solution, resulting in formation of HE powder agglomerates that remain stable as the solvents are removed from the reaction mixture during the agglomeration process. Further, the process is adjustable to substantially eliminate organic solvent contamination of the waste water stream.

11 Claims, No Drawings

SLURRY COATING METHOD FOR AGGLOMERATION OF MOLDING POWDERS REQUIRING IMMISCIBLE LACQUER SOLVENTS

FIELD OF THE INVENTION

The present invention is in the field of explosive and thermic compositions or charges. More specifically, the present invention relates to plastic bonded explosive compositions and methods for preparing such compositions.

BACKGROUND OF THE INVENTION

Coating techniques and equipment for producing plastic bonded explosive (PBX) molding powders are long known in the art. For example, see the *Encyclopedia of Explosives and Related Items* (S. M. Kaye, US Army Armament Research and Development Command, 1978, vol. 8, pages 62–65). Specifically, the Kaye reference at pages 64–65 and in FIG. 1 describes a slurry method for preparing PBX granules using an aqueous slurry.

Generally, in the aqueous slurry coating process, a high explosive (HE) powder is suspended in water in a reactor vessel with sufficient agitation or stirring to form an aqueous HE powder slurry. A lacquer containing a polymeric binder dissolved in an organic solvent (e.g., ethyl acetate) is added to the aqueous HE powder slurry with continuous agitation to form a mixture. The lacquer in the mixture, which is "sticky," causes the particles of the HE powder to agglomerate. To complete the agglomeration of the HE powder, the solvents are removed from the mixture, leaving hardened granules of polymer coated explosive—or molding powder.

Water is the preferred slurry medium, and the aqueous slurry coating process is most effective when the lacquer solvent is partially miscible/soluble with water. However, other slurry mediums are used when the suspended solids to be slurried are immiscible with water, or the lacquer solvent is insoluble in water. An example of the prior case is the manufacturing process for Magnesium-Teflon-Vitron (MVT) flare composition, where the finely powdered magnesium component is incompatible with water, n-Heptane is used as the slurry medium. An example of the latter case is the coating of HE powders (e.g., Composition CH-6) where the polymeric binder (polyisobutylene) is dissolved in a lacquer solvent (n-Octane) that is substantially insoluble in water. In this latter case, the aqueous HE powder slurry based agglomeration process can result in granules that are not well rounded.

The field has been motivated to develop alternatives to the aqueous slurring processes to address these limitations. For example, Chan et al., U.S. Pat. No. 5,750,921, describe a slurring process for producing HE molding powders using a non-aqueous medium (a liquid fluorocarbon) to suspend the initial explosive powder. Although the Chan process may be useful for its intended purpose, it would be beneficial to have an alternative aqueous slurring process that can avoid using fluorocarbons and utilize a lacquer solvent that is substantially insoluble in water and still produce HE molding powders having well rounded granules.

SUMMARY OF THE INVENTION

One of the benefit of an aqueous HE powder agglomeration process to produce PBX molding powder is the avoidance of using a substantial volume of potential pollutants that an analogous, but wholly organic solvent based agglomeration process can involve. However, it can be difficult to use the aqueous HE powder slurry process to form agglomerates with some polymeric binders, because the lacquer solvent is not soluble in the water phase of the aqueous slurry. For example, in the Ethyl vinyl acetate (EVA) coating of explosive powders, certain grades of EVA (specifically EVLAX 40W™) are dissolved using n-Butyl acetate. However, n-butyl acetate is substantially insoluble in water: 0.7 percent by weight at room temperature. During the removal of the solvents from the reaction (or agglomeration) mixture in the coating process, the agglomeration of the HE powder can fail or be lost, likely because of the insolubility of n-Butyl acetate in water.

The present invention relates to lacquer solution composition (stock solutions) useful in a coating process for producing HE molding powders coated with a binder that is solublized in a water immiscible solvent. Specifically, it is a coating process for producing HE molding powders utilizing an aqueous slurry medium and a lacquer stock solution comprising a solvent that is substantially immiscible in water, to produce HE molding powders having well rounded granules. The present invention uses the discovery that an HE agglomeration process utilizing an aqueous HE powder slurry comprising Ethyl acetate, upon the addition of a lacquer containing a substantially insoluble binder solvent, n-Butyl acetate, produced well rounded molding powder granules that retained their shape as the solvents were removed in the coating process.

The improved results embodied in the reaction mixture solutions of the present invention may have been accomplished by one or a combination of unexpected benefits resulting from the inclusion of Ethyl acetate to the aqueous HE powder slurry before addition of the lacquer to the slurry. One is that the adjustment of the surface tension of the aqueous phase by the Ethyl acetate, another is the modification of the wetting characteristics of the slurry, and still another is that the Ethyl acetate acts to entrain the n-Butyl acetate, making it more soluble in the water phase. The result was to produce agglomerate granules that were hardened or strengthened sufficiently to withstand the mechanical manipulation of agitation/stirring during the agglomeration process.

DETAILED DESCRIPTION OF THE INVENTION

The present invention relates to lacquer stock solutions and aqueous HE powder slurry solutions and the process of utilizing these solutions to produce PBX agglomerates. The present lacquer stock solution comprises a substantially water immiscible lacquer solvent and a polymeric binder. The aqueous HE powder slurry solution comprises an insoluble HE powder suspended in a solution of water and an at least partially water-miscible organic co-solvent. The lacquer stock solution is combined with the aqueous HE powder slurry solution to form a reaction mixture useful in an aqueous slurry coating process to produce PBX molding powder agglomerates.

The lacquer solution is a "stock" solution in that it is prepared separately from the aqueous slurry solution of the insoluble HE powder to which it is later added. The lacquer comprises a binder material dissolved in a substantially aqueous-immiscible organic solvent. The present lacquer stock solution is particularly useful for practice with binders that are not substantially soluble except in aqueous-immiscible organic solvents. Examples of such binders include: Ethyl Vinyl Acetate (e.g., ELVAX 40W®, E. I. Du Pont de Nemours and Co.), Polyisobutylene polymer (e.g., Vistanex®, Exxon-Mobil Chemical Co.), polyethylene wax, microcrystalline wax, montan wax, and Styrene, Ethylene and Butylene blocked-copolymers (e.g., Kraytona, Shell Chemical Co.). Examples of substantially aqueous-immiscible organic solvent intended for practice in the present lacquer stock solution include: n-Butyl Acetates; n-Octanes, Toluenes, Xylene, Hydrofluoroethers, tetrachloroethylenes, and methyl-isobutyl ketones.

In the preferred embodiment illustrated in the examples, the lacquer was prepared utilizing such a binder/solvent combination as described above. Specifically, Example I and II utilize an Ethyl Vinyl Acetate binder, certain grades of which are soluble in n-Butyl Acetate (which, for the purpose of the present invention, is a substantially immiscible organic solvent) and are not soluble in Ethyl Acetate, a more miscible organic lacquer solvent used in the art. In Example I below, the polymeric Ethyl Vinyl Acetate binder ELVAX 40W® was solubalized in the substantially water immiscible organic solvent, n-Butyl Acetate. 4.11 g of ELVAX 40W® was q.s. with n-Butyl acetate to provide a lacquer comprising 11.5 percent polymeric binder. For Example II below: the lacquer was prepared by solubalizing ELVAX 40W® in n-Butyl Acetate: 3.11 g of ELVAX 40W® was q.s. with n-Butyl acetate to provide a lacquer comprising 11.5 percent polymeric binder.

The lacquer is comprised of about 8 to 14 percent of binder material by weight. In the preferred embodiments of Examples I and II, the lacquer comprised about 10 to 12 percent binder material by weight, or more specifically, about 11.5 percent binder material by weight.

The aqueous HE powder slurry solution is either added to or concocted in the reaction vessel with continuous agitation or stirring. An aqueous HE powder slurry solution comprises a quantity of a water insoluble HE powder suspended in a solution of water and an at least partially miscible organic solvent. Generally, any water insoluble HE powder typically practicable in an aqueous slurry PBX agglomeration process is applicable in the present invention. Such HE powders include: an HMX, an RDX, a PETN, an HNS, a TATB, and a CL-20 HE powders. Typically, the water to HE powder ratio in the slurry solution is about 3:1 by weight.

As noted above, the slurry solution also contains an amount of an organic solvent that is at least partially miscible in water. Examples of such at least partially miscible solvents include: Ethyl Acetate, Acetone, Isopropyl Acetate, Propyl Acetate, Methyl Propyl Ketone, and Methyl Ethyl Ketone. The at least partially miscible organic solvent is a co-solvent which act to facilitate the proper combination of the lacquer that is later added to the slurry solution to form a reaction mixture. It appears that the co-solvent acts to entrain the lacquer solvent to make it more miscible in the water phase of the reaction mixture. In the embodiments illustrated in Examples I and II, Ethyl Acetate was the co-solvent included in the aqueous HE powder slurry solution. Apart from the Examples, an aqueous HE powder slurry solution may include about 0.5 to about 9.0 percent ethyl acetate by weight.

Further, as is known in the art, the aqueous HE powder slurry solution may include a surfactant. In the embodiment of Examples I and II, several drops of a 10 percent solution of a surfactant (RHODAPEX®, Rhodia Chemie Corp., France) was added to the slurry solution.

Generally, the aqueous slurry process for producing PBX molding powder agglomerates comprises the steps of combining in a reaction vessel, the aqueous HE powder slurry solution with an appropriate amount of the lacquer stock solution in a reaction vessel under constant agitation (stirring) produce a reaction mixture. Preferably, sufficient lacquer stock is added to the aqueous HE powder slurry solution to yield a reaction mixture between about 5 to 10 percent lacquer. However, other percent lacquer content of a reaction mixture are anticipated in the present invention, depending on the specific chemical characteristics of the solution components, the desired or acceptable percent coating and agglomerate granule shape. An appropriate amount of lacquer stock to add to the slurry solution is readily selectable by one of ordinary skill in the art in view of the teaching herein. Then under stepwise controlled conditions of temperature and/or vacuum and agitation, the solvents are removed from the reaction mixture and HE molding powder agglomerates are formed in the reaction vessel.

The reaction mixture is maintained in the reaction chamber of the reaction vessel with continuous stirring at moderate temperature until the reaction mixture is well mixed. The moderate mixing temperature of the reaction mixture can be from about ambient (20° C.) to about 60° C. The stirring rate or degree agitation during initial mixing will depend upon the size and configuration of the mixing/reaction chamber-impeller combination, and explosive/water ratio.

Next the solvents (water and organic solvents) are removed from the reaction mixture. This may be accomplished by increasing the temperature of the reaction mixture in the reaction chamber of the reaction vessel, by gas sweeping the reaction chamber, by drawing a vacuum on the reaction chamber, or a combination of these solvent removal means. Reaction mixture temperatures appropriate for the distillation or removal of solvents range from about 65° C. up to 100° C. Note: without the co-solvent entrainer in the reaction mixture, at temperatures above about 65° C. the agglomerates begin to fall apart. The controlled removal of the solvents from the reaction mixture causes the agglomeration of the HE powder with the polymeric binder material. Increasing or decreasing the stir rate can be used to control the size and/or shape of the agglomerate. Sufficiently higher stir rates competes with the agglomeration process and can limit the size the agglomerate granules attain. After the desired degree of agglomeration has reached, the process is ended.

Reaction vessels practicable in the present invention are known in the art. Components parts are commercially available, and the design and construction of an appropriate reaction vessel is readily accomplishable by one of ordinary skill in the art. For example, see Kasprzyk and Bell: *Characterization of a Slurry Process Used to Make a Plastic-Bonded Explosive.* The reaction vessel has an impeller/chamber configuration in part defined by the volume occupied by the reaction mixture and the surface area (if any) of the impeller (or other agitation means). The impeller or agitation means keeps the HE powder and the growing agglomerates suspended in the reaction mixture.

The reaction vessel is equipped with or accommodates a means for removing solvents (water and organic solvents) from the reaction mixture and eliminating them from the reaction vessel. This can be accomplished by any of a number of mechanisms known to the ordinary skilled artisan, such as gas sweeping and evacuation.

EXAMPLE I

Stock Solutions: 4% Polymeric Binder Coating of MHX

A lacquer was prepared by combining a polymeric binder, ELVAX 40W™, in a substantially water immiscible organic solvent, n-Butyl acetate: 4.11 g of ELVAX 40W™ was q.s. with n-Butyl acetate to provide a lacquer comprising 11.5 percent polymeric binder.

An aqueous HE powder slurry was prepared by combining 300 ml of DI water, 25 ml of Ethyl acetate, 5 drops of a 10 percent solution of a surfactant (RHODAPEX™, Rhodia Chemie Corp., France) and 100 g of Class-1 Cyclotetramethylene tetranitramine (HMX) powder, and in a reaction vessel agitating the combination by stirring.

Agglomeration Procedure: Example I

Time: 0

While stirring, adding the lacquer solution to the slurry to form a reaction mixture and adjusting the stir rate to ~300 rpm and the temperature of the mixture to about 56° C. to cause agglomeration.

Time: ~5 min.

Increasing the stir rate to ~570 rpm and forming a pasty-liquid of the mixture.

Time: ~7 min.

Adjust set point of reactor temperature control to 100° C.

Time: ~14 min.

Mixture temperature at 60° C., stir rate at ~570, mixture is developing a curd-like consistency.

Time: ~20 min.

Mixture temperature at 66° C., stir rate at ~570, mixture continues developing a curd-like consistency and becoming dryer.

Time: ~27 min.

Mixture temperature of 71° C., increase stir rate to ~610 rpm, mixture developing pasty granules.

Time: ~33 min.

Increase stir rate to ~750 rpm.

Time: ~34 min.

Mixture temperature at 74° C., mixture has become nicely granular.

Decrease stir rate to ~350 rpm, adjust set point of reactor temperature control to maintain temperature.

Time: ~48 min.

Add some water, increase stir rate to 700 rpm for 1 minute.

Time: ~49 min.

Mixture temperature at 72° C., no change in consistency of granules.

Decrease stir rate to ~400 rpm, adjust set point of reactor temperature controller to 120° C., add 25 ml water.

Time: ~53 min.

Stir rate ~400 rpm.

Add 25 ml water

Good agglomeration noted, enough solvent removed so agglomerates are firm(non-sticky), stirring stopped, liquid decanted, coated HMX granules placed in trays and dried in drying oven overnight.

End.

Results: molding powder granules having a 4% coating and a bulk density of about 0.779 g/cc.

EXAMPLE II

Stock Solution: 3% Polymeric Binder Coating of MHX

A lacquer was prepared by combining a polymeric binder, ELVAX 40W™, in a substantially insoluble organic solvent, n-Butyl acetate: 3.11 g of ELVAX 40W™ was q.s. with n-Butyl acetate to provide a lacquer comprising 11.5 percent polymeric binder.

An aqueous HE powder slurry was prepared by combining 300 ml of DI water, 15 ml of Ethyl acetate, 5 drops of a 10 percent solution of a surfactant (RHODAPEX™, Rhodia Chemie Corp., France) and 100 g of Class-1 Cyclotetramethylene tetranitramine (MHX) powder, and in a reaction vessel agitating the combination by stirring.

Agglomeration Procedure: Example II

Time: 0

While stirring, adding the lacquer solution to the slurry to form a reaction mixture and adjusting the stir rate to ~400 rpm and the temperature of the mixture to about 56° C. to cause agglomeration. Mixture forming a lumpy paste.

Time: ~5 min.

Mixture temperature at 56° C., stir rate at ~400 rpm, forming granules in lumpy paste.

Increase stir rate to ~700 rpm and adjust set point of reactor temperature control to 100° C.

Time: ~15 min.

Mixture temperature at 61° C., stir rate at ~700 rpm, developing large granules.

Time: ~24 min.

Increase stir rate to 825 rpm to control size of granules.

Time: ~26 min.

Reduce stir rate to ~515 rpm, mixture temperature at 70° C., nice granules after "grinding" mixture at 825 rpm.

Time: ~28 min.

Reduce stir rate to ~400 rpm, mixture temperature at 71° C.

Add 25 ml water (mixture temperature drops to ~66° C.).

Time: ~36 min.

Mixture temperature at ~75° C., and stir rate to ~400 rpm, granules holding together, Adjust set point of reactor temperature controller to 120° C.

Time: ~42 min.

Mixture temperature at ~78° C., stir rate at ~400 rpm., granules still holding together.

Time: ~46 min.

Mixture temperature at ~80° C., stir rate at ~400 rpm, nice granules have developed.

Time: 55 min.

Stir rate at ~400 rpm.

Add 50 ml water

Good agglomeration noted, enough solvent removed so agglomerates are firm(non-sticky), stirring stopped, liquid decanted, coated HMX granules placed in trays and dried in drying oven overnight.

End.

Results: molding powder granules having a 3% coating and a bulk density of about 0.826 g/cc.

Industrial facilities that produce PBX molding powders using prior aqueous slurry methods, typically had a large volume of solvent contaminated waste water to dispose of. A benefit of the present solutions and method is an aqueous slurry process for producing PBX molding powders that reduces the solvent contamination of the waste water stream to allow the waste water to be disposed of via a Publically Operated Treatment Works. In the hands of the ordinary skilled artisan, the present invention can be a best existing available technology for performing the aqueous slurry production of PBX molding powders, in keeping with the mandates of the Clean Water Act §306 (33 USC §1316). This is accomplishable in the present invention, at least in part, by selecting a system of organic solvents for use in the reaction mixture the combination of which is sufficiently immiscible in aqueous phase during the mixing stage of the process, but relatively less immiscible in the aqueous phase under the conditions of the agglomeration stage—where the organic solvents are removed/distilled from the reaction mixture. The organic solvents are preferentially removed from the reaction mixture during agglomeration, the vapors of which may themselves be trapped and recycled.

The combination of appropriate conditions of miscibility during mixing and during agglomeration/distillation in the above examples provided for the preferential removal of the organic solvents from the reaction mixture during the agglomeration stage. This left the resulting reaction mixture with an aqueous phase readily separable from any remaining solids. The resultant aqueous phase then may be recycled or discharged to a publicly operated treatment works, as appropriate.

While the above description contains many specifics, these should not be construed as limitations on the scope of the invention, but rather as exemplifications of one or another preferred embodiment thereof. Many other variations are possible, which would be obvious to one skilled in the art. Accordingly, the scope of the invention should be determined by the scope of the appended claims and their equivalents, and not just by the embodiments.

What is claimed is:

1. Solutions for preparing a reaction mixture useful to produce coated HE powder agglomerates in an aqueous slurry process comprising:

a lacquer stock solution comprising a binder material dissolved in a substantially aqueous-immiscible organic lacquer solvent; and an aqueous HE powder slurry solution comprising a non-aqueous soluble HE powder and an at least partially aqueous-miscible organic co-solvent.

2. The reaction mixture solutions of claim 1, wherein the lacquer stock solution comprises a binder material comprising an Ethyl vinyl acetate.

3. The reaction mixture solutions of claim 1, wherein the lacquer stock solution comprises a substantially aqueous-immiscible organic solvent comprising an n-Butyl acetate.

4. The reaction mixture solutions of claim 1, wherein the lacquer stock solution is comprised of about 8 to 20 percent binder material by weight.

5. The reaction mixture solutions of claim 1, wherein the lacquer stock solution is comprised of about 10 to 12 percent binder material by weight.

6. The reaction mixture solutions of claim 1, wherein the lacquer stock solution is comprised of about 11.5 percent binder material by weight.

7. The reaction mixture solutions of claim 1, wherein the aqueous HE powder slurry solution comprises a non-aqueous soluble HE powder comprising HMX.

8. The reaction mixture solutions of claim 1, wherein the aqueous HE powder slurry solution comprises an at least partially aqueous-miscible organic co-solvent comprising ethyl acetate.

9. The reaction mixture solutions of claim 1, wherein the aqueous HE powder slurry solution comprises about 4 to 9 percent ethyl acetate by weight as the at least partially aqueous-miscible organic solvent.

10. The reaction mixture solutions of claim 1, wherein the aqueous HE powder slurry solution further comprises a surfactant.

11. The reaction mixture solutions of claim 1, wherein the aqueous HE powder slurry solution comprises a water to HE powder ration of about 3 to 1 by weight.

* * * * *

UNITED STATES PATENT AND TRADEMARK OFFICE

CERTIFICATE OF CORRECTION

PATENT NO. : 6,630,040 B2
DATED : October 7, 2003
INVENTOR(S) : Philip Kneisl

It is certified that error appears in the above-identified patent and that said Letters Patent is hereby corrected as shown below:

Title page,
Item [74], *Attorney, Agent or Firm*, delete "L. Jeffrey" and insert -- L. Jeffery --.
Item [57], ABSTRACT,
Line 15, delete "waste water" and insert -- wastewater --.

Column 2,
Line 17, delete "solublized" and insert -- solubilized --.

Column 3,
Line 19, delete "solubalized" and insert -- solubilized --.
Line 23, delete "solubalizing" and insert -- solubilizing --.

Column 6,
Lines 57 and 60, delete "waste water" and insert -- wastewater --.

Signed and Sealed this

Sixteenth Day of December, 2003

JAMES E. ROGAN
*Director of the United States Patent and Trademark Office*